US007775465B2

(12) United States Patent
Burchardt et al.

(10) Patent No.: US 7,775,465 B2
(45) Date of Patent: Aug. 17, 2010

(54) METHOD AND APPARATUS FOR GRINDING IRON ORE OR IRON ORE CONCENTRATE

(75) Inventors: Egbert Burchardt, Everswinkel (DE); Franz-Josef Zurhove, Bad Iburg (DE)

(73) Assignee: Polysius AG (DE)

( * ) Notice: Subject to any disclaimer, the term of this patent is extended or adjusted under 35 U.S.C. 154(b) by 654 days.

(21) Appl. No.: 10/914,916

(22) Filed: Aug. 10, 2004

(65) Prior Publication Data

US 2005/0072273 A1 Apr. 7, 2005

(30) Foreign Application Priority Data

Aug. 11, 2003 (DE) ..... 103 36 801

(51) Int. Cl.
*B02C 7/00* (2006.01)
*B02C 23/08* (2006.01)

(52) U.S. Cl. ..... 241/24.25; 241/79.1; 241/80

(58) Field of Classification Search ..... 241/20, 241/23, 79, 79.1, 80, 24.1, 24.25
See application file for complete search history.

(56) References Cited

U.S. PATENT DOCUMENTS 2,835,452 A * 5/1958 Cline et al. ..... 241/23
2,962,231 A * 11/1960 Weston ..... 241/24.14
3,512,722 A * 5/1970 Hall ..... 241/24.11
4,889,289 A * 12/1989 Lohnherr et al. ..... 241/18
5,669,559 A * 9/1997 Wagner et al. ..... 241/23
5,897,063 A * 4/1999 Patzelt et al. ..... 241/24.1

* cited by examiner

*Primary Examiner*—Faye Francis
(74) *Attorney, Agent, or Firm*—Gifford, Krass, Sprinkle, Anderson & Citkowski, P.C.

(57) ABSTRACT

A method and apparatus for grinding iron ore or iron ore concentrate is able to grind iron ore or iron ore concentrate economically. In the method and apparatus disclosed, the material is ground in circulation in a material bed roll mill, one fraction of the iron ore or iron ore concentrate ground in the material bed roll mill is recirculated to the material bed roll mill and the other fraction of the iron ore or iron ore concentrate is classified into oversize material and fines, and the oversize material is returned to the material bed roll mill.

1 Claim, 2 Drawing Sheets

METHOD AND APPARATUS FOR GRINDING IRON ORE OR IRON ORE CONCENTRATE

FIELD OF THE INVENTION

The invention relates to a method and apparatus for grinding iron ore or iron ore concentrate in which the material is ground in circulation in a material bed roll mill in order to be able to grind iron ore or iron ore concentrate economically.

BACKGROUND OF THE INVENTION

It is known to use the material bed roll mill with single or multiple circulation for grinding iron ore or iron ore concentrate to of pelletizing fineness. However, a pelletizable product can only be produced on the material bed roll mill in this way with appropriate pre-treatment of the feed material. In this case, it is necessary in particular to eliminate the oversize material with a particle size greater than 100 μm. Grinding of concentrate with a particle size of more than approximately 200 μm to pelletizing fineness is not possible with this method.

Material bed roll mills are not currently used in closed circuit with classifying assemblies for grinding iron ore or iron ore concentrate, since this is not currently considered to be feasible or economical.

In wet classification, the entire liquid cyclone underflow must be returned to the material bed roll mill. As a result, moisture contents of the feed would be produced in the material bed roll mill at which the material would no longer be drawn in. However, filtration of the entire cyclone underflow in order to reduce the moisture content would be uneconomical.

SUMMARY OF THE INVENTION

The object of the invention therefore is to provide a method and an apparatus with a material bed roll mill in order to be able to grind iron ore or iron ore concentrate economically.

According to the method of the invention for grinding iron ore or iron ore concentrate, the material is ground in circulation in a material bed roll mill, one fraction of the iron ore or iron ore concentrate ground in the material bed roll mill being recirculated to the material bed roll mill and the other fraction of the iron ore or iron ore concentrate being classified into oversize material and fines, the oversize material being returned to the material bed roll mill.

The method with a material bed roll mill and classifier can be implemented and rendered economical in that the circulation via the classifier is markedly reduced by sufficient recirculation of scabs.

According to a first embodiment, a wet classification process is used for classifying the ground iron ore or iron ore concentrate.

According to a second embodiment, the ground iron ore or iron ore concentrate is dried before classification.

In order to ensure an economical process, the quantity of ground iron ore or iron ore concentrate to be recirculated after the material bed roll mill is set so that the ratio of oversize material to fines at the classifier is not greater than three.

The apparatus for grinding the iron ore or iron ore concentrate according to the first embodiment substantially comprises a material bed roll mill and a separating arrangement for dividing the iron ore or iron ore concentrate ground in the material bed roll mill into a first material stream which is recirculated to the material bed roll mill and a second material stream. Furthermore, a wet classifier is provided which classifies the second material stream into oversize material and fines, and also transporting means is provided for transporting the oversize material from the wet classifier to the material bed roll mill.

In a special variant of this embodiment, means are provided for reducing the moisture content of the oversize material before it is fed to the material bed roll mill.

According to the second embodiment, the apparatus for grinding the iron ore or iron ore concentrate substantially comprises a material bed roll mill and a separating arrangement for dividing the iron ore or iron ore concentrate ground in the material bed roll mill into a first material stream which is recirculated to the material bed roll mill and a second material stream. Furthermore, a classifier is provided which classifies the second material stream into oversize material and fines, and also transporting means is provided for transporting the oversize material from the classifier to the material bed roll mill as well as drying means is provided for drying the second material stream before it is delivered to the classifier.

BRIEF DESCRIPTION OF THE DRAWINGS

Further advantages and embodiments of the invention are explained in greater detail with reference to the following description of some embodiments and the drawings, in which.

DETAILED DESCRIPTION OF THE INVENTION

Figure 1:
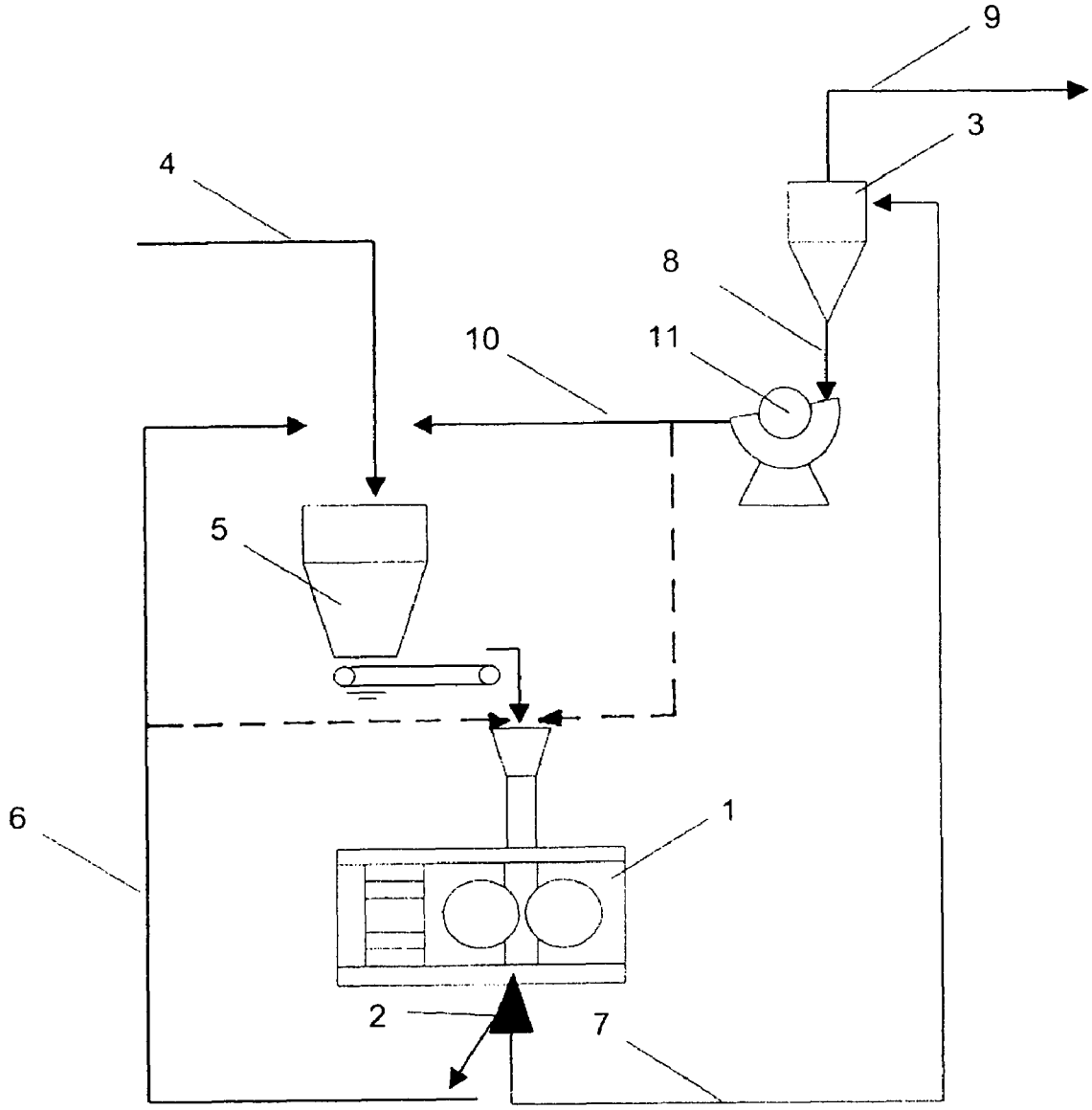
FIG. 1 shows a schematic representation of the apparatus for grinding iron ore or iron ore concentrate according to the first embodiment.

The apparatus for grinding iron ore or iron ore concentrate shown in FIG. 1 basically comprises a material bed roll mill 1, a separating arrangement 2 and a wet classifier 3.

The iron ore or iron ore concentrate 4 to be ground is fed via a storage bin 5 to the material bed roll mill 1. The material bed roll mill is well known in the art and operates at such high pressures that so-called material bed comminution takes place.

After the material bed roll mill, the ground iron ore or iron ore concentrate proceeds to the separating arrangement 2 where it is divided quantitatively into a first material stream 6 and a second material stream 7. While the first material stream 6 is recirculated via the storage bin 5 to the material bed roll mill, the second material stream 7 proceeds to the wet classifier 3. There, the second material stream 7 is classified into oversize material 8 and fines 9. The oversize material 8 is transported via transport means 10 back to the material bed roll mill 1.

Optionally, at least a proportion of the first material stream 6 and at least a proportion of the oversize material can be transported to the material bed roll mill 1, bypassing the storage bin 5, as is indicated by the broken lines.

Since due to the wet classification, the oversize material 8 has a relatively high moisture content, which might render difficult or prevent drawing in of the material in the material bed roll mill 1, means 11 for reducing the moisture content of the oversize material can be provided if needed. In this way, at least a portion of the moisture can be extracted from the oversize material 8 before it is returned to the material bed roll mill 1, so that no problem will occur when the material is drawn into the material bed roll mill 1.

Figure 2:
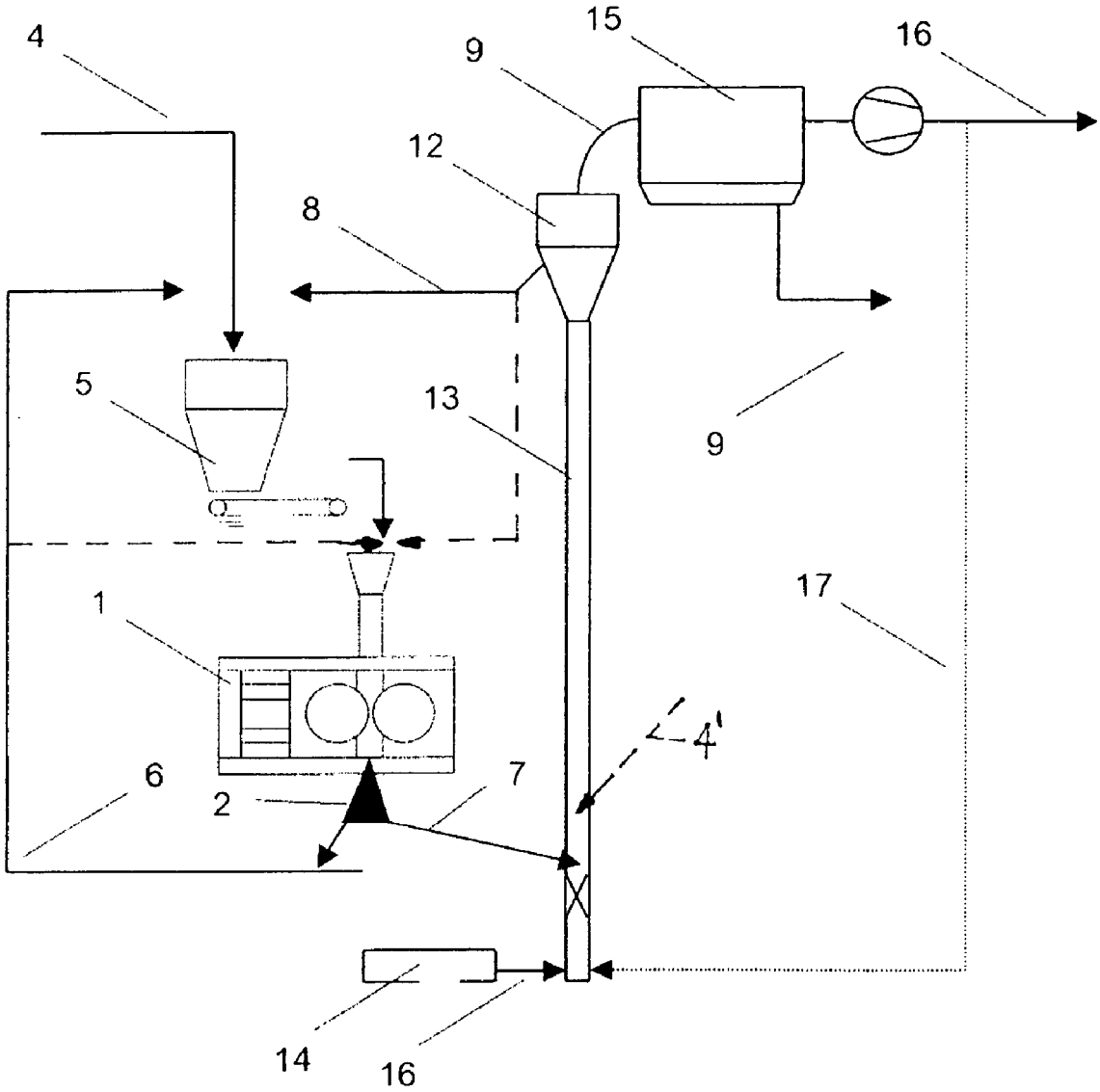
FIG. 2 shows a schematic representation of the apparatus for grinding iron ore or iron ore concentrate according to the second embodiment.

In the second embodiment according to FIG. 2, a material bed roll mill 1, a separating arrangement 2 and a classifier 12 are again provided.

The iron ore or iron ore concentrate 4 to be ground proceeds via the storage bin 5 into the material bed roll mill 1. In the separating arrangement 2, the ground iron ore or iron ore concentrate is divided into a first material stream 6 and a second material stream 7. While the first material stream 6 is recirculated back to the material bed roll mill 1, the second material stream 7 proceeds into the classifier 12 which classifies the second material stream 7 into oversize material 8 and fines 9. The oversize material 8 is transported via transport means 10 from the classifier to the material bed roll mill 1.

In contrast to the first embodiment, the classifier 12 is constructed as a dry classifier. Since the ground iron ore or iron ore concentrate 4 is relatively moist, the second material stream 7 on its way to the classifier 12 passes through means 13 for drying the second material stream. The means 13 are formed, for example, by a pneumatic conveyor dryer which is supplied with a hot gas stream 16, particularly hot air. Therefore, a corresponding hot gas producer 14 is provided at the lower end of the means 13.

The fines 9 are led together with the gas stream into a filter 15 which separates the fines 9 from the gas stream 16. A proportion of the gas stream 16 can optionally be returned via a pipe 17 to the lower end of the means 13 (pneumatic conveyor dryer).

According to the broken line 4', further iron ore or iron ore concentrate can also optionally be fed in the region of the means 13.

Within the scope of the invention, it is also conceivable that the fines merely constitute an intermediate product which is finally ground to pelletizing fineness in a subsequent material bed roll mill in single or multiple circulation without classification.

With both embodiments, it is possible to grind the iron ore or iron ore concentrate 4 to a of pelletizing fineness. This corresponds for example to a Blaine fineness of 1600 to 2200. In order to make an economical mode of operation possible, the ratio of oversize material 8 to fines should not be greater than 3. Therefore with a predetermined degree of fineness of the finished material, the quantity of the first material stream 6 to be recirculated must be set accordingly.

What is claimed is:

1. A method of grinding iron ore or iron ore concentrate comprising the steps of:

grinding iron ore or iron ore concentrate in circulation in a material bed roll mill;

separating quantitatively the iron ore or iron ore concentrate from the material bed roll mill into one fraction and other fraction;

sending the one fraction of the iron ore or iron ore concentrate to the material bed roll mill;

classifying the other fraction of the iron ore or iron ore concentrate into oversize material and fines by performing a wet classification process on the ground iron ore or iron ore concentrate;

extracting at least a portion of moisture from the oversize material before returning the oversize material to the material bed roll mill; and returning the oversize material to the material bed roll mill with the ratio of oversize material to fines not being greater than 3, thereby grinding the iron ore or iron ore concentrate to a Blaine fineness of 1600 to 2200.

* * * * *